United States Patent [19]

Carter

[11] 4,221,387

[45] Sep. 9, 1980

[54] GAME BOARD APPARATUS FOR GAME OF STRATEGY AND CHANCE

[76] Inventor: Danny L. Carter, 24 W. 700 South, Pleasant Grove, Utah 84062

[21] Appl. No.: 919,735

[22] Filed: Jun. 27, 1978

[51] Int. Cl.[2] ..... A63F 3/00

[52] U.S. Cl. ..... 273/236

[58] Field of Search ..... 273/243, 261, 271, 266, 273/236

[56] References Cited

U.S. PATENT DOCUMENTS 262,066 0/1882 Linton ..... 273/236

1,760,642 5/1930 Graham ..... 273/271

FOREIGN PATENT DOCUMENTS 2699 of 1890 United Kingdom ..... 273/271

OTHER PUBLICATIONS

Grunfeld, et al., *Games of the World,* Holt, Rinehart and Winston, ©1975.

*Primary Examiner*—Richard C. Pinkham

*Assistant Examiner*—R. Carl Moy

*Attorney, Agent, or Firm*—Howard I. Podell

[57] ABSTRACT

A game apparatus having a hexagonal game board bearing ninety-one smaller identical hexagons; four six-sided die each of different colors representing arbitrary game importance; each die having two equilateral triangles on opposing faces such that each triangle has an apex pointing to a common side and a base parallel to the edge of the face opposite the common side; a set of two squares one of which is placed with its edges parallel to the edges of the face that has two of its edges parallel to the bases of the triangles while the other square is similarly placed on the side opposite its companion square and circles on each of the two remaining sides; and a corresponding set of forty-eight playing pieces for each die.

2 Claims, 3 Drawing Figures

GAME BOARD APPARATUS FOR GAME OF STRATEGY AND CHANCE

FIELD OF THE INVENTION

This invention relates generally to a novel game wherein the element of chance neutralizes difference in playing level of the players.

DESCRIPTION OF THE PRIOR ART

The prior art, as exemplified by U.S. Pat. Nos. 2,703,713; 3,697,076; 1,165,688; 521,737; 611,450 or 598,969 is generally illustrative of the pertinent art but the aforementioned patents are non-applicable to the present invention as they disclose non-hexagonal game board or a different design.

The principal object of this invention is to provide a device or article of this character which combines simplicity and durability in a high degree, together with inexpensiveness of construction owing to a minimum of parts so as to encourage widespread use thereof.

Additional objects and advantages of the invention will be set forth in part in the description which follows and in part will be obvious from the description, or may be realized by practive of the invention, the objects and advantages being realized and attained by means of the instrumentalities and combinations particularly pointed out in the appended claims.

SUMMARY OF THE INVENTION

This invention resides in a game apparatus having a hexagonal game board bearing ninety-one smaller identical hexagons; four six-sided die each of different colors representing arbitrary game importance; each die having two equilateral triangles on opposing faces such that each triangle has an apex pointing to a common side and a base parallel to the edge of the face opposite the common side; a set of two squares one of which is placed with its edges parallel to the edges of the face that has two of its edges parallel to the bases of the triangles while the other square is similarly placed on the side opposite its companion square square and circles on each of the two remaining sides; and a corresponding set of forty-eight playing pieces for each die.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
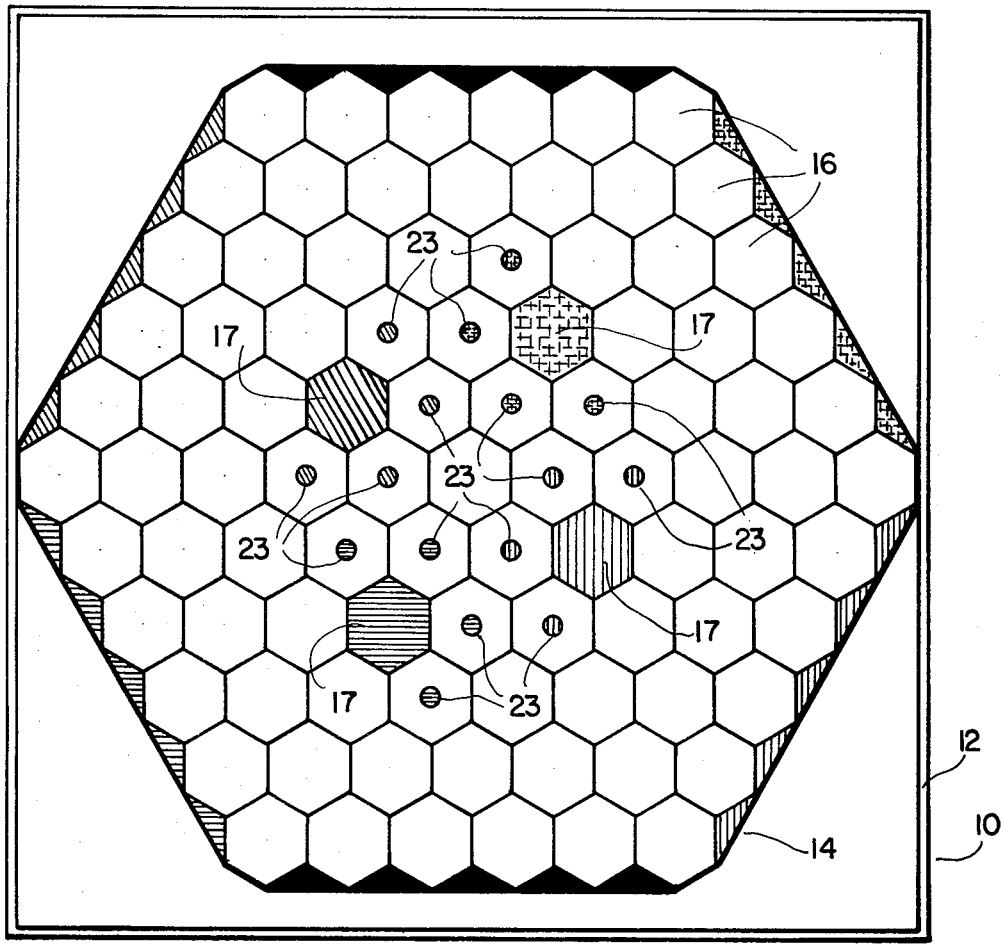
FIG. 1 is a plan view of the board or surface upon which the game of the invention is played.
Figure 2:
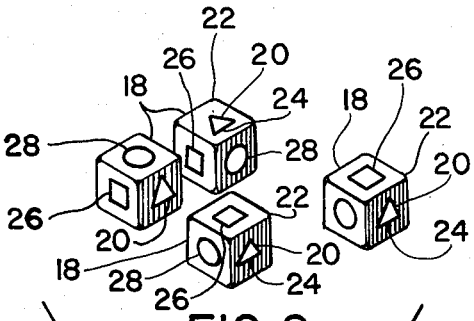
FIG. 2 is a perspective view of the four dice used.

With reference to the drawing, there is shown and illustrated game apparatus for a game I call "Trap" constructed in accordance with the principles of the invention and designated generally by reference character 10. The illustrated tangible embodiment of the invention includes a game board 12 made of plastic, wood, cardboard or other suitable material on which is imprinted a game surface 14 in the shape of a hexagon. The game surface into ninety-one small hexagons 16 called territories and four differently colored domains 17.

The board can be played on by two to four players using four dice 18 of different colors, red, blue, green and yellow. Each die has markings thereon as follows: two equilateral triangles 20 on opposing faces such that each triangle has an apex pointing to a common side 22 and a base 24 parallel to the edge of the face opposite the common side; a set of two squares 26 one of which is placed with its edge parallel to the edges of the face that has two of its edges parallel to the bases of the triangles 20 while the other square is similarly placed on the side opposite its companion square and circles 28 on each of two remaining sides. It should be noted that the symbols on the dice match the symbols on the colony chips. The dice will determine the order of play, which chips are played, and (in most cases) the length of each player's turn.

Figure 3:
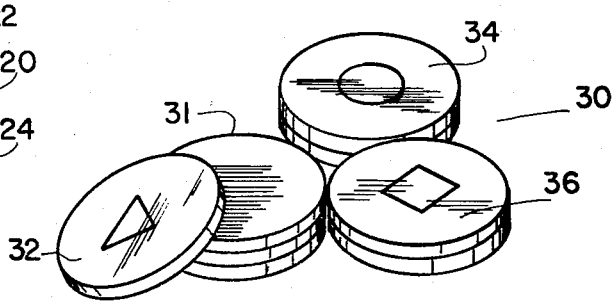
FIG. 3 is a perspective view of the play pieces used in the game.

As shown in FIG. 3, there are four sets of chips 30 colored to match the initial domains on the playing board. Each set contains forty-eight chips divided into two categories as follows. The chips 30 are of a diameter such as to be contained within hexagons 16.

Each set contains twelve unmarked chips 31. These blank chips are the player's fortresses called simply, forts, used to mark the extract of each player's domain 17 throughout the game.

There are thirty-six chips in each set that have been marked with geometric shapes; twelve 32 with triangles, twelve with circles 34 and twelve 36 with squares. These are the player's colonies, used to occupy territories and extend the player's domain 17 by capturing territories occupied by the other players chips. Each domain is surrounded by six other territories four of these 23, having a circle with a color matching the adjoining domain.

The object of the game is to capture territories that are occupied by the other player's chips, as will be described below.

The Capture Rule:

When one or more territories are occupied by foreign chips, those territories may be captured by a player if that player can place his own chips in all of the bordering territories. Territories that are captured are said to be "caught in a Trap".

The Six Corners Rule:

The outermost territories may be captured by trapping them against the outer edge of the board. However, such a trap is not valid if it contains within it one or more of the six territories that mark out the six corners of the board. These six territories may be used to create a trap, but they can never be caught in one.

How The Game is Played:

Preparing the game:

The order of play rule:

The order of play is determined by the colors of the dice. The dice must be chosen by lot. The order of play is as follows: red, first player; blue, second player; green, third player (if three play); yellow, fourth player (if four play).

This rule states that the dice must be drawn out of a hat without looking. Also, the die drawn by each player will determine the order of his turn and the color of the chips he will be using. (He must use the chips bearing the color of his die.)

The Initial Domain:

The first round of play will be used to set up the initial domain of each player.

The Initial Domain Rule:

In turn, each player must place one of his forts (unmarked chips) on the initial domain terriorty bearing his color. Next, he must place any one of his colonies (chips marked with symbols) on any one of the dotted territories bearing his color.

These steps ready the game for play.

To Begin Play:

The player with the red die is the first attacker. The next player in line (according to the order of play) will defend the board. When an attacker's turn ends, the defender becomes the new attacker and the next player in line becomes the new defender. As the play moves around the board, each player is first a defender and then an attacker.

The Attack:

The purpose of an attack is to surround and thereby capture one or more territories that are occupied by the other players' chips. An attack consists of a series of plays as follows.

At the beginning of each play, the attacker and the defender roll their dice at the same time. The defender tries to end the attack by matching the roll of the attacker.

The Defender's Rule:

When the dice are rolled and the symbol on the top face of the defender's die matches the symbol on the top face of the attacker's die, then the defender has blocked the attack and the attacker's turn is immediately ended.

Otherwise stated the defender can end the attacker's turn by rolling a matching symbol.

The Attacker's Rule:

When the dice are rolled and the top symbol on the defender's die does not match the top symbol on the attacker's die, then the defender has failed to block the attack, and the attacker may select a colony (bearing a symbol matching his die) and place it on the board.

Otherwise stated, an attacker may make a play if he is not blocked by the defender, and that the colony he plays must bear the same symbol as that shown on his die.

The preceding rule states when a colony may be placed on the board. The following rules state where a colony may be placed.

The Vacant Territory Rule:

An attacker may place his colony on a vacant territory only if that territory lies adjacent to at least one territory that is already occupied by any one of his other colonies.

This means that new territories may be colonized by an attacker only if they lie adjacent to his previously colonized territories. The attacker should realize that he may place colony on a territory next to one of his forts only if that territory is also adjacent to at least one of his other colonies.

The Occupied Territory Rule:

An attacker may take over a territory that is already occupied by another player's colony if the symbols on both colonies are the same, and if the territory also meets the requirements (other than vacancy) set forth in the vacant territory rule.

Remember, the object is to capture occupied territories, not take them over. However, it often necessary to take over some territories in order to capture others. It may also be necessary to take over occupied territories to avoid being caught in another player's trap. Although this is a defensive maneuver, an attacker is at liberty to use any play as a defensive or an attacking play at any time during the course of his turn.

Whenever a territory is taken over, the chip that is replaced must be returned to the player who owns it to be used again.

After the attacker places the colony, the dice are rolled again and the play is repeated. The attacker's turn will not end until one of two events occurs. Either the attacker will be matched by the defender on one of his rolls and lose his turn immediately, or he will make enough plays to complete a trap and capture one or more territories. When a capture is made, all foreign chips (colonies and forts) that are caught in the trap must be removed from the board and replaced by the attacker's forts. The foreign chips are then returned to the players who own them and they may be used again. This completes the attack and the attacker's turn is ended.

The game includes additional rules as follows:

The Free Play Rule:

At the beginning of an attack, the attacker may place any one of his colonies on any one of his dotted territories 23 if that territory 23 is unoccupied. This must be done before the attacker makes his first play.

The Exchange Rule:

At the beginning of an attack, the attacker may find that he has no colonies or unoccupied dotted territories left on the board from which he can launch an attack. If this happens, the attacker may exchange any one of his forts for any one of his colonies. He may then launch his attack from this colony. If an attacker has no colonies, no unoccupied dotted territories, and no forts left on the board, then he cannot make an attack and he is therefore eliminated from the game.

The Forefeit Rule:

During the course of an attack, the attacker may find that all twelve of his colonies bearing the symbol he has rolled are already on the board. If this happens, the attacker must forfeit the play and re-roll the dice. If an attacker finds that all of his colonies have been placed on the board, he must forfeit his turn until at least one of his colonies is eliminated from the board and returned to him. In this event, the player is advised to re-read the rules of play and develop a new line of strategy.

The Winner's Rule:

A player wins the game if he is the first player to get all twelve of his forts on the board at one time. A player wins by default if all other players are eliminated from the game by the conditions described in the exchange rule.

Summary of the rules.

The Order of Play Rule:

The dice are drawn by lot. The order of play is: red, first; blue, second; green, third; yellow, fourth.

The Initial Domain Rule:

The first round of play is used to set up the board as each player, in turn, places one fort on the initial domain, and one colony on one of his dotted territories.

The Defender's Rule:

When the defender's die matches the attacker's die, the attacker's turn is ended.

The Attacker's Rule:

When the defender's die does not match the attacker's die, then the attacker may play a colony having a symbol matching his die.

The Vacant Territory Rule:

An attacker may place his colony on a vacant territory only when that territory is adjacent to at least one of his other colonies.

The Occupied Territory Rule:

An attacker may use his colony to take over a territory that is occupied by a foreign colony if the two colonies have matching symbols, and if the territory is adjacent to at least one of the attacker's other colonies.

The Capture Rule:

Territories occupied by foreign chips are captured when the attacker occupies all bordering territories with his own chips. (Chips includes both forts and colonies.)

The Six Corners Rule:

The six corner territories may be used by an attacker to trap territories occupied by foreign chips, but the corner territories cannot be contained within a valid trap.

The Free Play Rule:

An attacker may place any one of his colonies on any one of his unoccupied dotted territories at the beginning of any attack, provided he does so before he begins rolling the dice for that attack.

The Exchange Rule:

In order to have a colonized territory from which he can launch an attack, the attacker may exchange one of his forts for one of his colonies if there is no alternative course of action.

The Forefeit Rule:

The attacker must forfeit the play if he has already played all of the colonies bearing the symbol he rolled. The attacker must forfeit the attack if he has no colonies left to play.

The Winner's Rule:

A player wins the game by being the first to have all of his forts on the board at one time. A player may win by default if all other players are eliminated from the game.

The operation and use of the invention hereinabove described will be evident to those skilled in the art to which it relates from a consideration of the foregoing.

The present invention is believed to accomplish among others all of the objects and advantages herein set forth.

Without further analyses, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. Board game apparatus for play by a plurality of players, comprising a game board, a first quantity of dice, and a first quantity of sets of game pieces, in which the game board is divided into a plurality of blocks of similar size and shape with a first quantity of first blocks that are spaced apart from each other, each individually distinctively marked with a different first indication so as to each represent the indication of a "initial domain" block of a specific player of the game, and with a second quantity of second blocks each distinctively marked with a second indication so as to each represent the indication of "initial territory" of a specific player, such that each "initial territory" block is adjacent to an "initial domain" block marked with the same player indication, and with said second quantity being a multiple of said first quantity, with said first quantity being set to equal the maximum number of different players that may play the game as one time, and in which each die is of the shape of a cube, with each face of the cube marked with one of a first, second or third symbol so that each of said three symbols is marked on two faces of each die, and with each die distinctively marked with an indication representing a specific player of the game said die indication corresponding to a respective first indication on said first blocks, and in which each set of game pieces includes a plurality of four groups of pieces, each of a size to fit within a block of the game board, and all of the game pieces of a set being marked with an indication representing a specific player of the game said game piece indication corresponding to a respective first indication on said first blocks, and with one group of game pieces of each set identified as a group of "fort" pieces, and with each of the game pieces of each group identified by markings of a said symbol so that a complete set includes a group of "fort" pieces and three different groups of game pieces identified as "colony" pieces of said specific player said three groups of "colony" pieces each having thereon one of a first, second or third type of symbol corresponding to a respective one of said first, second or third symbols on said die, such that the opposing players may place their "colony" pieces and "fort" pieces on the board, capture the "colony" pieces and "fort" pieces of their opponents and replace the captured pieces by their "fort" pieces, in accordance with throw of the dice and the rules of the game, with the object of each player being to place all of his "fort" pieces on the game board to win the game, and with each throw of the dice resulting in the indication of one of the three different groups of colony pieces.

2. The game as recited in claim 1 in which the said first quantity is four and the said second quantity is four, in which each block is in the shape of a hexagon so that each block on the interior of the board is surrounded by six adjacent blocks, so that each "initial domain" block is surrounded by two unmarked blocks and by four "initial territory" blocks identified with the indication of a specific player of the game, and with the game being playable by up to four different players at one time.

* * * * *